US005325588A

United States Patent [19]

Rogers

[11] Patent Number: 5,325,588

[45] Date of Patent: Jul. 5, 1994

[54] KNIFE WITH MULTIPLE CUTTING POSITIONS

[76] Inventor: Carl E. Rogers, 12005 Lake Lery Ave., Baton Rouge, La. 70816

[21] Appl. No.: 57,255

[22] Filed: May 4, 1993

[51] Int. Cl.[5] ..... B26B 1/04

[52] U.S. Cl. ..... 30/161; 30/155; 30/158; 30/159

[58] Field of Search ..... 30/161, 160, 159, 158, 30/155

[56] References Cited

U.S. PATENT DOCUMENTS

| | | | |
|---|---|---|---|
| 292,473 | 1/1884 | Dieterich et al. | 30/161 |
| 512,965 | 1/1894 | Hoyez | 30/161 |
| 1,469,957 | 10/1923 | Rich . | |
| 2,651,106 | 9/1953 | Breitzke | 30/125 |
| 2,651,839 | 9/1953 | Folland | 30/125 |
| 2,681,505 | 6/1954 | Flanagan | 30/125 |
| 3,783,509 | 1/1974 | Lake | 30/161 |
| 4,233,737 | 11/1980 | Poehlmann | 30/335 |
| 4,425,709 | 1/1984 | Quenzi | 30/151 |
| 4,730,394 | 3/1988 | Sonner, Jr. | 30/161 |
| 4,893,409 | 1/1990 | Poehlmann | 30/161 |
| 5,125,157 | 6/1992 | Howard | 30/123 |

*Primary Examiner*—Richard K. Seidel
*Assistant Examiner*—Hwei-Siu Payer
*Attorney, Agent, or Firm*—Robert C. Tucker; William David Kiesel; Warner J. Delaune, Jr.

[57] ABSTRACT

A knife having angularly adjustable cutting positions is provided, comprising a blade having a base portion, the base portion having an outer edge including an engagement portion including a positioning mechanism for positioning the blade in multiple angular cutting positions with reference to a handle; a handle including a biased locking member for selectively engaging the positioning mechanism and fixing the blade in each of the angular cutting positions, the handle having a blade end; a spring, positioned in the handle, for biasing the locking member against the positioning mechanism; and wherein the base portion of the blade is pivotally attached to the blade end of the handle at a pivot point located within the blade end.

18 Claims, 4 Drawing Sheets

KNIFE WITH MULTIPLE CUTTING POSITIONS

BACKGROUND OF THE INVENTION

1. Field of the Invention

This invention relates generally to knives and, more particularly, to knives having multiple angular cutting positions.

2. Prior Art

In some applications it is desirable to use knives with different angular cutting positions. For example, when hunting it is desirable to use a knife having an angle between the cutting portion of the blade and the handle of slightly less than 180 degrees for field dressing an animal. It is also desirable to use a knife having an angle between the cutting portion of the blade and the handle of slightly greater than 180 degrees for skinning an animal. Prior to the invention disclosed herein, sportsmen often carried two specialized knives to accomplish these two tasks. Of course, the extra bulk and expense of the dual knife system is undesirable, particularly under rugged hunting conditions.

In order to address the need for adjustable blades, prior art knife designs have resorted to interchangeable blades, or to adjustable knives with relatively complex adjustment mechanisms requiring the removal of wing nuts and the like for adjustment or replacement of the blade. Again, in outdoor applications, such mechanisms are undesirable due to the possibility of losing knife parts as well as the difficulty encountered in adjusting the angle of the blade. As a result, most hunters desiring knives having field dressing, skinning or other specialized angular positions continue to carry multiple fixed blade knives in multiple scabbards or multiple folding knives.

SUMMARY OF THE INVENTION

It is therefore an object of this invention to provide a single blade knife having a blade which is easily and quickly adjustable between a plurality of cutting positions.

It is another object of this invention to provide a single blade knife having multiple cutting positions which does not require the removal of any hardware to adjust the knife between cutting positions.

It is yet another object of this invention to provide a single blade knife having multiple cutting positions, and which also adjusts to a folded, or closed, position.

It is further object of this invention to provide a single blade knife having multiple cutting positions which accomplishes various combinations or all of the above objects.

Accordingly, a knife having angularly adjustable cutting positions is provided, comprising a blade having a base portion, the base portion having an outer edge including an engagement portion including a positioning mechanism for positioning the blade in multiple angular cutting positions with reference to a handle; a handle including a biased locking member for selectively engaging the positioning mechanism and fixing the blade in each of the angular cutting positions, the handle having a blade end; a spring, positioned in the handle, for biasing the locking member against the positioning mechanism; and wherein the base portion of the blade is pivotally attached to the blade end of the handle at a pivot point located within the blade end.

Various embodiments of the knife are possible, including folding and non-folding versions as disclosed herein.

DETAILED DESCRIPTION OF PREFERRED EMBODIMENTS OF THE INVENTION

Figure 4:
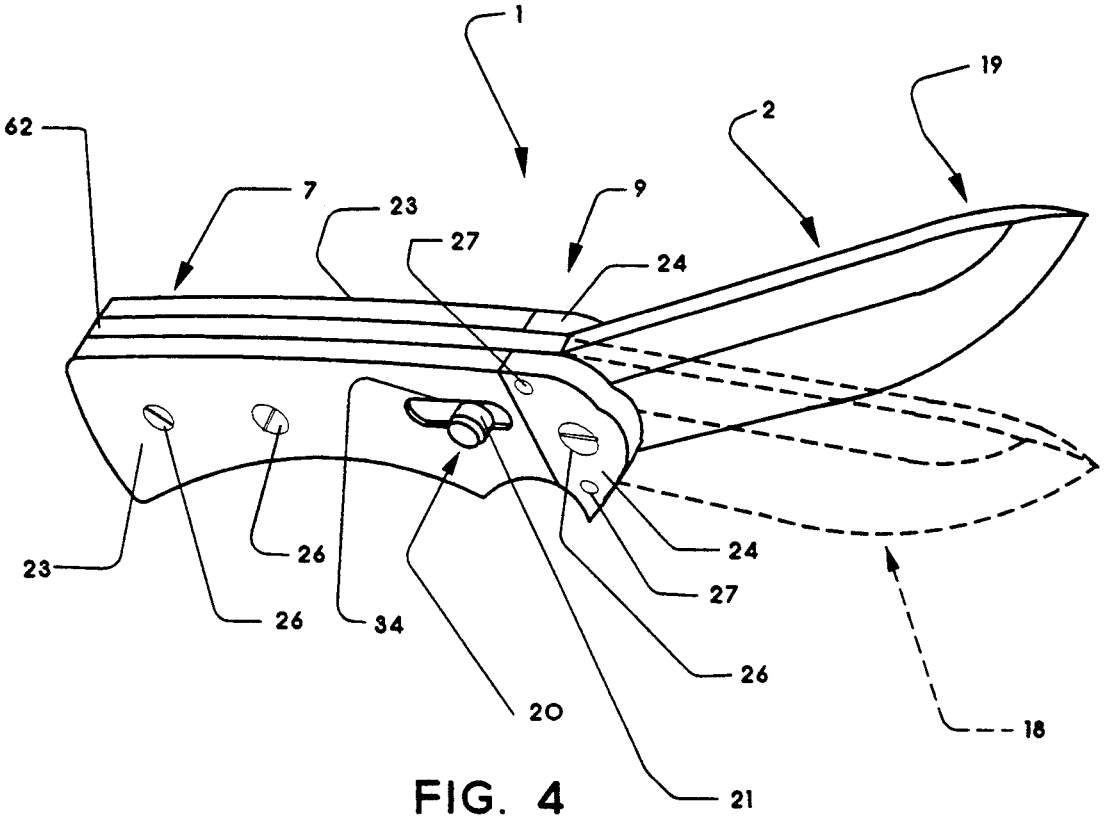
FIG. 4 is an assembled perspective view of the embodiment of the invention shown in FIGS. 1–3.
Figure 6:
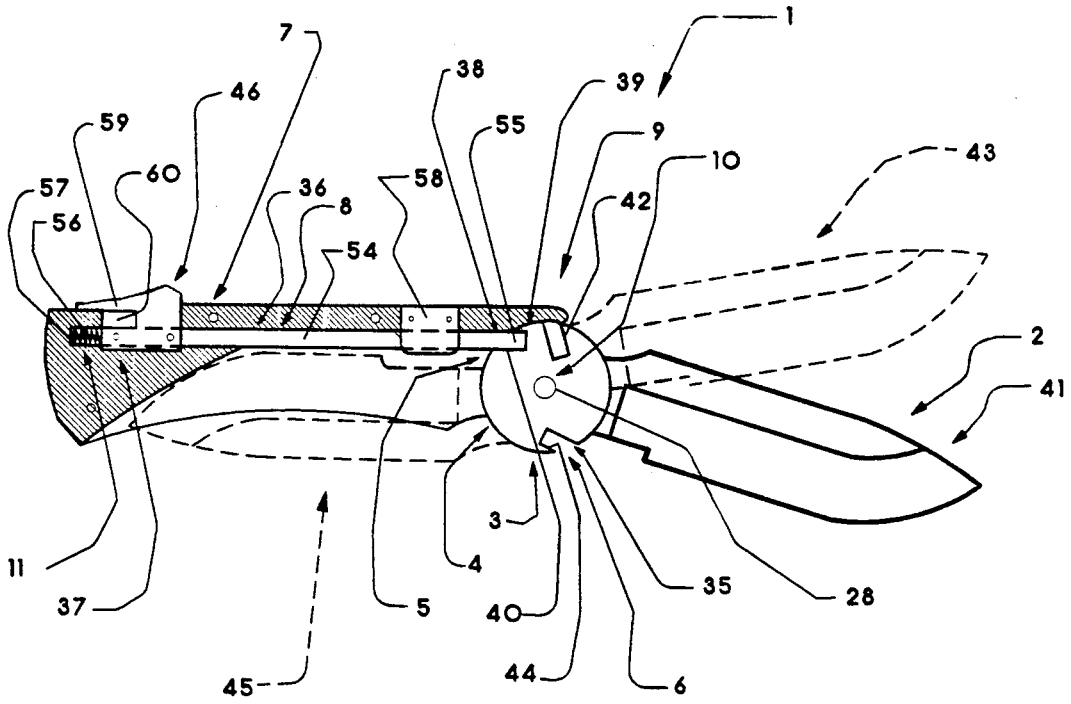
FIG. 6 is a sectional side view of an alternate folding embodiment of the invention.
Figure 5:
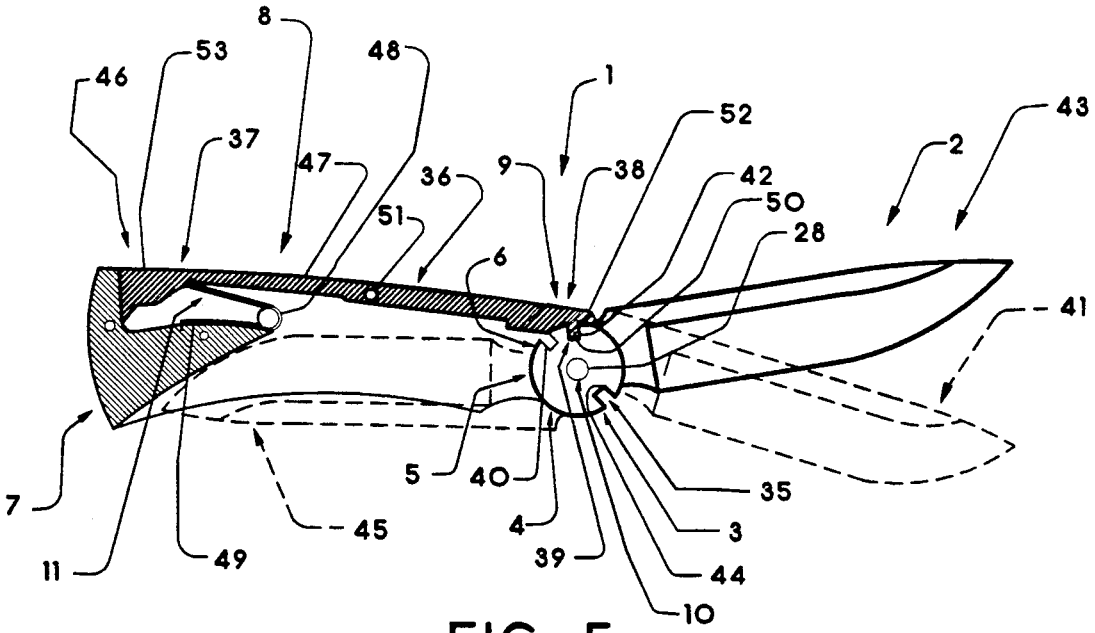
FIG. 5 is a sectional side view of a folding embodiment of the invention.

The invention, as shown in the Figures, comprises a knife 1 having a plurality of angularly adjustable cutting positions. The knife 1 includes a blade 2 having a base portion 3 having an outer edge 4 which further includes an engagement portion 5. Engagement portion 5 includes a positioning means 6 for positioning blade 2 in a plurality of angular cutting positions with reference to handle 7. Handle 7 includes a biased engagement means 8 for selectively engaging positioning means 6 and fixing blade 2 in each of the angular cutting positions. Handle 7 has a blade end 9, where base portion 3 of blade 2 is pivotally attached at pivot point 10 within base portion 3, as shown. A resilient means 11, for biasing engagement means 8 against positioning means 6, is positioned in handle 7. Various embodiments of the knife 1 are shown in the Figures. FIGS. 1–4 depict a non-folding version having two cutting positions. FIG. 5 depicts a version which can have a folded or closed position and two or more cutting positions. FIG. 6 depicts an alternate version which can also have a folded or closed position and two or more cutting positions. Each version will be explained in greater detail below.

Figure 1:
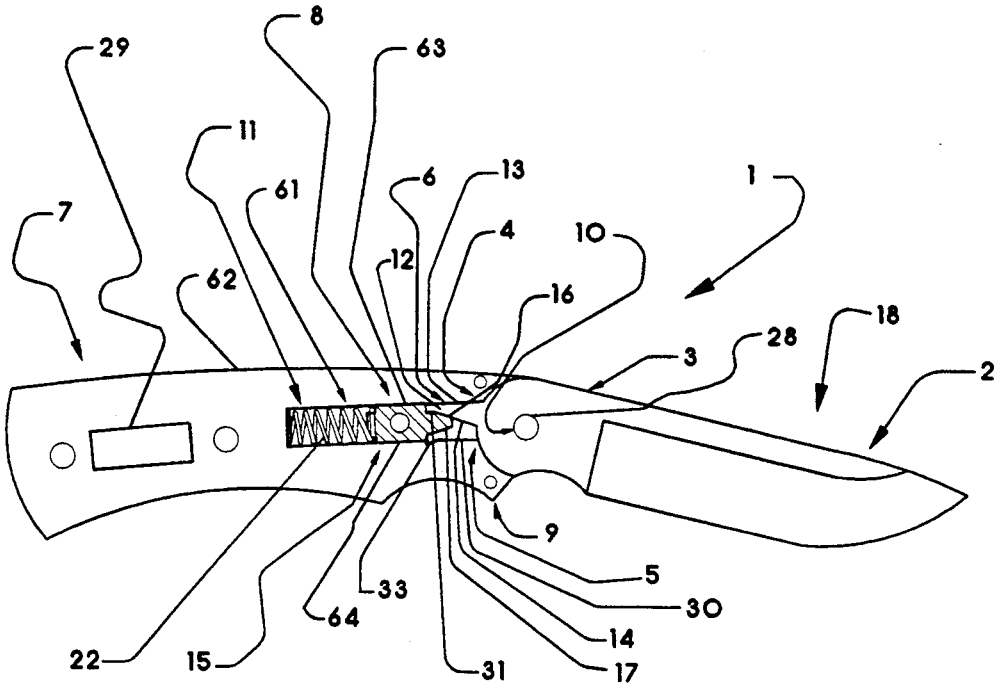
FIG. 1 is a sectional side view of an embodiment of the non-folding version of the invention in a first cutting position.
Figure 2:
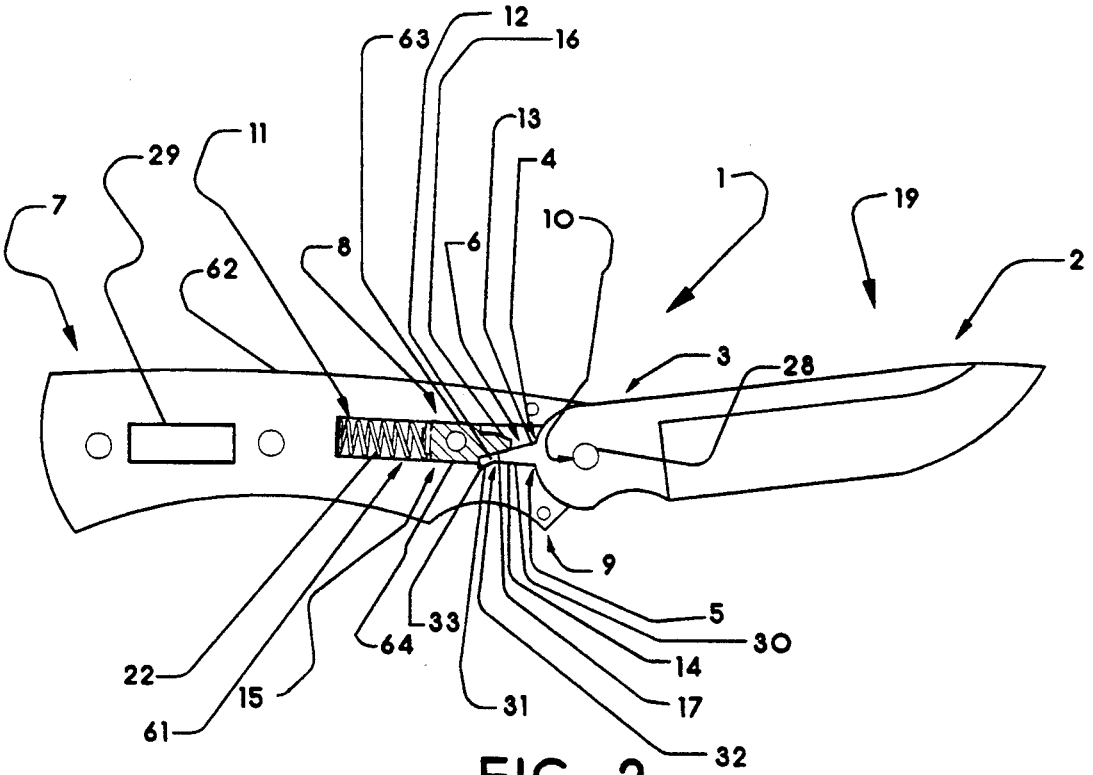
FIG. 2 is a sectional side view of the embodiment shown in FIG. 1 in a second cutting position.

As shown in FIGS. 1 and 2, the non-folding version of the knife 1 includes a positioning means 6 comprising a tail portion 12 extending from base portion 3 of blade 2. Tail portion 12 includes an upper surface 13 and a lower surface 14. As shown in the FIG. 3, tail portion 12 is preferably the same approximate thickness as base portion 3 of blade 2. Engagement means 8 comprises a locking member 15 which is slidably positioned in handle 7 between resilient means 11 and base portion 3 of blade 2. Preferably, locking member 15 is approximately the same thickness as tail portion 12 and has an upper surface 16, which is matingly engageable, within a recess 61 in handle 7, with lower surface 14 of tail portion 12 in a first cutting position 18, and a lower surface 17, which is matingly engageable with upper surface 13 of tail portion 12 in a second cutting position 19. As shown, the positioning of tail portion 12 on base portion 3 and the angles of upper surface 16 and lower surface 17 determine the angular adjustment between first cutting position 18 and second cutting position 19. In first cutting position 18, tail portion 12 is fixed between upper surface 16 of the locking member 15 and upper wall 63 of recess 61. In second cutting position 19, tail portion 12 is fixed between lower surface 17 of locking member 15 and lower wall 64 of recess 61. Preferably, lower surface 14 of tail portion 12 includes a primary segment 30 and an end segment 31, with primary segment 30 and said end segment 31 forming an obtuse angle 32, as shown in FIG. 2. This arrangement prevents blade 2 from moving from first cutting position 18 to second cutting position 19 without the user forcibly retracting locking member 15. It is preferable that a slight indentation 33 in lower wall 64 be formed so as to matingly receive end segment 31.

A means 20 is provided for retracting locking member 15 against resilient means 11 and away from engagement with tail portion 12 so as to allow blade 2 to be pivoted between first cutting position 18 and second cutting position 19. Means 20 preferably comprises an actuator member 21 connected to and extending outward from locking member 15 through actuator slot 34 in handle 7 to a point exterior of handle 7, as shown, such that locking member 15 may be operated with the thumb or other fingers.

Figure 3:
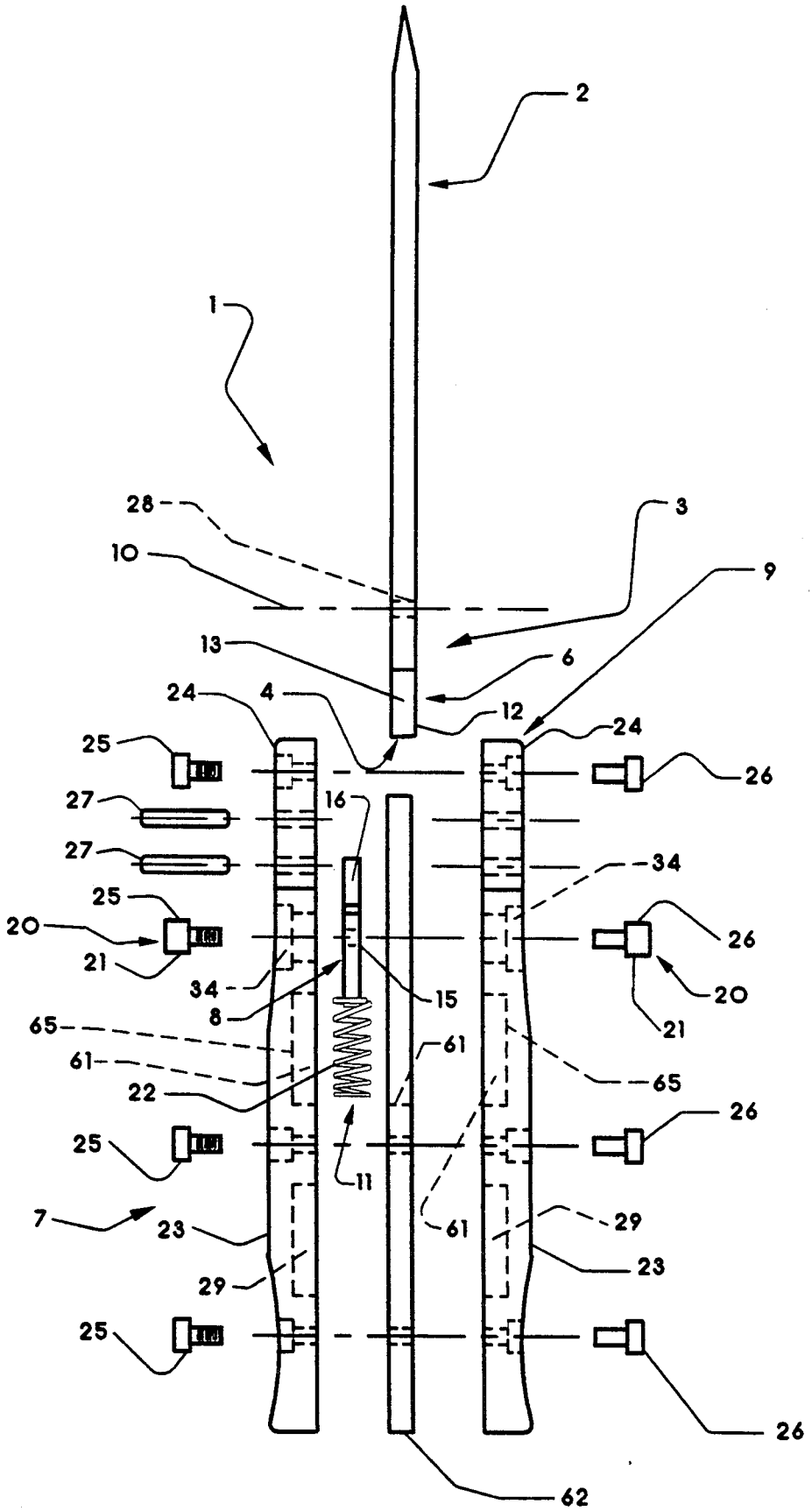
FIG. 3 is an exploded top view of the embodiment of the invention shown in FIGS. 1 and 2.

Resilient means 11 preferably comprises a spring 22, which is contained in an enclosed spring recess 65 in handle 7, as shown in FIG. 3, which forms a portion of recess 61. Tail portion 12 protrudes into recess 61 and into contact with locking member 15, which is interposed between spring 22 and said tail portion 12. Handle 7 may be constructed as known in the art, provided that the elements of the invention 1 are contained accordingly. As shown in FIGS. 3 and 4, handle 7 may include handle scales 23 and hilt plates 24, which contain spacer plate 62. Handle 7 is held together by bolts 25, nuts 26 and peening pins 27 as needed. One bolt 25 and nut 26 combination occupies pivot point 10 and passes through pivot hole 28 in base portion 3 of blade 2. A spare spring compartment 29 may be provided in handle 7, as shown.

The embodiments shown in FIGS. 5 and 6 may be used for folding and non-folding knives, and may include multiple cutting positions. Both embodiments include a positioning means 6 comprising a plurality of slots 35 spaced apart on outer edge 4 of base portion 3 of blade 2 and extending into base portion 3. Engagement means 8 comprises a locking member, generally denoted by 36, positioned in handle 7. Locking member 36 has a base end 37 and an engagement end 38. An engagement tab 39 extends from engagement end 38, and is selectively and matingly insertable into a first slot 40 in first cutting position 41. Engagement tab 39 is also selectively and matingly insertable into a second slot 42 in a second cutting position 43. If a third slot 44 is provided, engagement tab 39 is selectively and matingly insertable into third slot 44 in a folded, or closed, position 45. Locking member 36 is positioned in handle 7 such that resilient means 11 is biased against locking member 36, urging engagement tab 39 against outer edge 4 of blade 2 and into one of the slots 40,42,44 when aligned therewith. Locking member 36 further comprises a means 46 for retracting locking member 36 against resilient means 11 and away from outer edge 4 so as to allow blade 2 to be pivoted between cutting positions 41,43 and/or closed position 45. Again, handle 7 may be constructed as known in the art, provided that the elements of the invention 1 are contained accordingly. Of course, additional cutting positions may be provided by adding more slots 35.

The particular embodiment shown in FIG. 5 utilizes a pivoting locking member 47, which is pivotally attached to handle 7 using a pin 51 or other means known in the art. Resilient means 11, preferably a spring 48, is interposed between a fixed point 49 on handle 7 and base end 37 of locking member 47 such that engagement tab 50, which preferably extends angularly from engagement end 38 toward pivot point 10, is pivotally urged against outer edge 4 of base portion 3 of blade 2 and into one of the slots 40,42,44 when aligned therewith. In the embodiment shown in FIG. 5, slots 40,42,44 are substantially radially spaced with reference to pivot point 10 so as to be alignable with engagement tab 50. A tip portion 52 may be added to extend from engagement end 38 to cover empty slot 42 when blade 2 is in first position 41. Means 46 for retracting locking member 47 includes an exposed portion 53 of base end 37 of locking member 47 exposed exterior of handle 7 so as to enable base end 37 to be urged against resilient means 11, thus disengaging tab 50.

FIG. 6 depicts an embodiment of the invention 1 utilizing an axial locking member 54, which is slidably positioned in handle 7. Engagement tab 55 extends generally axially from locking member 54. Resilient means 11, preferably a spring 56, is interposed between a fixed point 57 on handle 7 and base end 37 of locking member 54. Engagement tab 55 is axially urged against outer edge 4 and into one of the slots 40, 42, 44 when aligned therewith. In the embodiment shown in FIG. 6, slots 40, 42, 44 are offset from pivot point 10, or substantially tangential with reference to pivot point 10, so as to be alignable with engagement tab 55. Of course, locking member 54 could be aligned with pivot point 10, allowing radial slots 40, 42, 44 to be used similar to those of FIG. 5, as well as other tab/slot configurations. Slide support 58, or other suitable means known in the art, provides support for locking member 54. Means 46 for retracting locking member 54 includes an actuator member 59 connected to and extending outward from locking member 54 to a point exterior of handle 7 through actuator slot 60.

As can be seen a versatile knife is provided which is easily adjustable between angular cutting positions without interchanging blades or removing hardware from the knife. The knife is adaptable to both folding and non-folding embodiments. Upon a review of the disclosure contained herein, other embodiments of the invention may occur to those skilled in the art, and such embodiments are intended to be included within the scope and spirit of the following claims.

I claim:

1. A knife having angularly adjustable cutting positions, comprising:

a. a blade having a base portion, said base portion having an outer edge including an engagement portion including a positioning means for positioning said blade in a plurality of angular cutting positions with reference to a handle, said positioning means comprising a tail portion extending from said base portion of said blade and into said handle, said tail portion having an upper surface and a lower surface;

b. said handle including a biased engagement means for selectively engaging said positioning means and fixing said blade in each of said angular cutting positions, said handle having a blade end, said engagement means comprising a locking member slidably positioned in said handle between said resilient means and said base portion of said blade, said locking member having an upper surface matingly engageable with said lower surface of said tail portion in a first cutting position, and a lower surface matingly engageable with said upper surface of said tail portion in a second cutting position, said locking member further having a means for retracting said locking member against a resilient means and away from engagement with said tail portion so as to allow said blade to be pivoted between said first cutting position and said second cutting position; and said resilient means for biasing said engagement means against said positioning means, said resilient means being positioned in said handle; and wherein said base portion of said blade is pivotally attached to said blade end of said handle at a pivot point located within said base portion.

2. A knife according to claim 1, wherein said means for retracting said locking member includes an actuator member connected to and extending outward from said locking member to a point exterior of said handle.

3. A knife according to claim 1, wherein said lower surface of said tail portion includes a primary segment and an end segment, said primary segment and said end segment forming an obtuse angle.

4. A knife according to claim 1, wherein said resilient means comprises a spring, and wherein said handle includes a recess into which said tail portion protrudes, said recess further containing said locking member interposed between said spring and said tail portion.

5. A knife according to claim 4, wherein said handle includes a spare spring compartment.

6. A knife having angularly adjustable cutting positions, comprising:

a. a blade having a base portion, said base portion having an outer edge including an engagement portion including a positioning means for positioning said blade in a plurality of angular cutting positions with reference to a handle, said positioning means comprising a plurality of slots spaced apart on said outer edge of said blade and extending into said base portion;

b. said handle including a biased engagement means for selectively engaging said positioning means and fixing said blade in each of said angular cutting positions, said handle having a blade end, said engagement means comprising a locking member positioned in said handle, said locking member having a base end, an engagement end and an engagement tab extending from said engagement end, said engagement tab being selectively and matingly insertable into a first of said slots in a first cutting position, and selectively and matingly insertable into a second of said slots in a second cutting position, said locking member being positioned in said handle such that a resilient means is biased against said locking member so as to urge said tab against said outer edge of said blade and into one of said slots when aligned therewith, said locking member further having a means for retracting said locking member against said resilient means and away from engagement with said outer edge so as to allow said blade to be pivoted between said cutting positions;

c. said resilient means for biasing said engagement means against said positioning means, said resilient means being interposed between a fixed point on said handle and said base end of said locking member, and said locking member is slidably positioned in said handle such that said tab extends generally axially from said locking member and is axially urged against said outer edge of said base portion of said blade and into one of said slots when aligned therewith; and wherein said base portion of said blade is pivotally attached to said blade end of said handle at a pivot point located within said base portion.

7. A knife according to claim 6, wherein said slots are substantially tangential with reference to said pivot point.

8. A knife according to claim 6, wherein said resilient means comprises a spring.

9. A knife according to claim 6, wherein at least three of said slots are provided, with said engagement tab being selectively and matingly insertable into a third of said slots in a closed position.

10. A knife according to claim 9, wherein said means for retracting said locking member includes an actuator member connected to and extending outward from said locking member to a point exterior of said handle.

11. A knife having angularly adjustable cutting positions, comprising:

a. a blade having a base portion, said base portion having an outer edge including an engagement portion including a positioning means for positioning said blade in a plurality of angular cutting positions with reference to a handle, said positioning means comprising a plurality of slots spaced apart on said outer edge of said blade and extending into said base portion;

b. said handle including a biased engagement means for selectively engaging said positioning means and fixing said blade in each of said angular cutting positions, said handle having a blade end, said engagement means comprising a locking member positioned in said handle, said locking member having a base end, an engagement end and an engagement tab extending from said engagement end, said engagement tab being selectively and matingly insertable into a first of said slots in a first cutting position, and selectively and matingly insertable into a second of said slots in a second cutting position, said locking member being positioned in said handle such that a resilient means is biased against said locking member so as to urge said tab against said outer edge of said blade and into one of said slots when aligned therewith, said locking member further having a means for retracting said locking member against said resilient means and away from engagement with said outer edge so as to allow said blade to be pivoted between said cutting positions, said handle further including means, in operational connection with said second slot, for covering said second slot when said blade is fixed in said first cutting position;

c. said resilient means for biasing said engagement means against said positioning means, said resilient means being positioned in said handle; and wherein said base portion of said blade is pivotally attached to said blade end of said handle at a pivot point located within said base portion.

12. A knife according to claim 11, wherein at least three of said slots are provided, with said engagement tab being selectively and matingly insertable into a third of said slots in a closed position.

13. A knife according to claim 12, wherein said means for retracting said locking member includes an actuator member connected to and extending outward from said locking member to a point exterior of said handle.

14. A knife according to claim 11, wherein said resilient means is interposed between a fixed point on said handle and said base end of said locking member, and said locking member is pivotally attached to said handle such that said tab is pivotally urged against said outer edge of said blade and into one of said slots when aligned therewith.

15. A knife according to claim 14, wherein said means for retracting said locking member includes an exposed portion of said base end of said locking member exposed exterior of said handle so as to enable said base end of said locking member to be urged against said resilient means.

16. A knife according to claim 14, wherein said engagement tab extends angularly from said engagement end of said locking member, and said slots are substantially radially spaced with reference to said pivot point.

17. A knife according to claim 16, wherein said resilient means comprises a spring.

18. A knife according to claim 11, wherein said means for covering said second slot comprising a tip portion extending from said engagement end of said locking member, said tip portion having sufficient dimensions to cover said second slot when said blade is fixed in said first cutting position.

* * * * *